US005534200A

United States Patent [19]

Erilli et al.

[11] Patent Number: 5,534,200

[45] Date of Patent: *Jul. 9, 1996

[54] GELLED MICROEMULSION CLEANING COMPOSITION

[75] Inventors: Rita Erilli, Liege; Maria Galvez, Grace Hollogne, both of Belgium

[73] Assignee: Colgate-Palmolive Co., Piscataway, N.J.

[ * ] Notice: The term of this patent shall not extend beyond the expiration date of Pat. No. 5,393,468.

[21] Appl. No.: 270,000

[22] Filed: Jul. 1, 1994

Related U.S. Application Data

[63] Continuation-in-part of Ser. No. 91,774, Jul. 14, 1993, abandoned.

[51] Int. Cl.[6] ..... C11D 1/065

[52] U.S. Cl. ..... 510/396; 252/315.1; 510/403; 510/429; 510/461; 510/497; 510/498; 510/536; 510/365; 510/417

[58] Field of Search ..... 252/122, 174.11, 252/170, 171, 162, 546, 548, 552, 554, 553

[56] References Cited

U.S. PATENT DOCUMENTS

| | | | |
|---|---|---|---|
| 4,749,516 | 6/1988 | Brusky | 252/546 |
| 4,919,839 | 4/1990 | Durbut et al. | 252/153 |
| 5,075,026 | 12/1991 | Loth et al. | 252/122 |
| 5,076,954 | 12/1991 | Loth et al. | 252/122 |
| 5,082,584 | 1/1992 | Loth et al. | 252/122 |
| 5,108,643 | 4/1992 | Loth et al. | 252/122 |

*Primary Examiner*—Paul Lieberman
*Assistant Examiner*—Necholus Ogden
*Attorney, Agent, or Firm*—Richard E. Nanfeldt; James Serafino

[57] ABSTRACT

A composition comprising approximately by weight 13 to 50% of a mixture of two different anionic surfactants, one of said anionic surfactants being a sulphonate and the other said anionic surfactant being a sulphate, a ratio of said paraffin sulphonate to said alkyl ether sulphate being 10:1 to 1:10; 4 to 20% of at least one of a water insoluble organic compound; 5 to 20% of at least one water soluble hydroxy containing organic compound; and the balance being water, wherein the composition has a pH of about 1 to about 11.

9 Claims, No Drawings

GELLED MICROEMULSION CLEANING COMPOSITION

RELATED APPLICATION

This application is a continuation in part application of U.S. Ser. No. 08/091,774 filed 7/14/93, now abandoned.

BACKGROUND OF THE INVENTION

This invention relates to a gelled microemulsion cleaning composition and to processes for manufacture and use thereof. More particularly, it relates to a stable gelled microemulsion cleaning composition in concentrated form which is especially effective to clean oily and greasy soils from vertical surfaces such as bathroom fixtures and walls, leaving such surfaces clean and shiny without the need for extensive rinsing thereof. The described compositions comprise a mixture of anionic surfactants, a water insoluble organic compound having an $\delta_H$ of about 0 to about 1 $(MPa)^{1/2}$, $\delta_d$ of about 14 to about 18 $(MPa)^{1/2}$, and $\delta_p$ of about 0 to about 2 $(MPa)^{1/2}$, water and a suitable co-surfactant system, which co-surfactant system adjusts the interface conformation to reduce interfacial tension at interfaces between dispersed and continuous phases of the emulsion of the surfactants, produces a stable gelled microemulsion at room temperature. When the pH of the gelled microemulsion is on the acid side, preferably in the range of 1 to 4, the invented compositions are useful for removing lime scale and soap scum from hard substrates.

Liquid detergent compositions, usually in solution or emulsion form, have been employed as all-purpose detergents and have been suggested for cleaning hard surfaces such as painted woodwork, bathtubs, sinks, tile floors, tiled walls, linoleum, paneling and washable wallpaper. Many such preparations, such as those described in U.S. Pat. No's. 2,560,839, 3,234,138, and 3,350,319 and British Patent Specification No. 1223739, include substantial proportions of inorganic phosphate builder salts, the presence of which can sometimes be found objectionable for environmental reasons and also because they necessitate thorough rinsing of the liquid detergent from the cleaned surface to avoid the presence of noticeable depositings of phosphate thereon. In U.S. Pat. No's. 4,017,409 and 4,244,840 liquid detergents of reduced phosphate builder salt contents have been described but such may still require rinsing or can include enough phosphate to be environmentally objectionable. Some liquid detergents have been made which are phosphate-free, such as those described in U.S. Pat. No. 3,935,130, but these normally include higher percentages of synthetic organic detergent which increased detergent content may be objectionable due to excessive foaming during use that can result from its presence. The previously described liquid detergent compositions are emulsions but are not disclosed to be pseudo microemulsions like those of the present invention.

Microemulsions have been disclosed in varic, us patents and patent applications for liquid detergent compositions which may be useful as hard surface cleaners or all-purpose cleaners, and such compositions have sometimes included detergent, solvent, water and a co-surfactant. Among such disclosures are European Patent Specification No's. 0137615, 0137616, and 0160762, and U.S. Pat. No. 4,561,448, all of which describe employing at least 5% by weight of the solvent in the compositions. The use of magnesium salts to improve grease removing performance of solvents in microemulsion liquid detergent compositions is mentioned in British Patent Specification No. 2144763. Other patents on liquid detergent cleaning compositions in microemulsion form are U.S. Pat. No's. 3,723,330, 4,472,291, and 4,540,448. Additional formulas of liquid detergent compositions in emulsion form which include hydrocarbons, such as terpenes, are disclosed in British Patent Specifications No's. 1603047 and 2033421, European Specification No. 0080749, and U.S. Pat. No's. 4,017,409, 4,414,128, and 4,540,505. However, the presence of builder salt in such compositions, especially in the presence of magnesium compounds, tends to destabilize the microemulsions and therefore such builders are considered to be undesirable.

Although the cited prior art relates to liquid all-purpose detergent compositions in emulsion form and although various components of the present compositions are mentioned in the art, it is considered that the art does not anticipate or make obvious the gelled microemulsions disclosed and claimed herein. In accordance with the present invention a stable gelled microemulsion cleaning composition, which is in concentrated form, comprises at least two different anionic synthetic organic detergent, a water insoluble organic compound, water and a co-surfactant system, which co-surfactant system adjusts interfacial conformation to reduce interfacial tension at interfaces between dispersed and continuous phases of an emulsion of said surfactants, and produces a stable concentrated gelled microemulsion which is stable at temperatures in the range of 5° to 50° C. and which has a pH in the range of 1 to 11. Such concentrated gelled microemulsions are dilutable with water to at least five times their weight, to produce diluted liquid detergent compositions which are often also stable aqueous pseudo microemulsions which are useful as all-purpose cleaning compositions. Both the concentrated gelled and diluted compositions are effective for cleaning oily and greasy soils from substrates, and when the compositions are acidic they are also useful to remove lime scale and soap scum from hard surfaces, such as bathroom fixtures, floors and walls.

In addition to the gelled microemulsion concentrates, the present invention also relates to dilute pseudo microemulsions to processes for manufacturing such pseudo microemulsions and to processes for cleaning surfaces with them.

SUMMARY OF THE INVENTION

The present invention provides an improved liquid cleaning composition in the form of a gelled microemulsion which is suitable for cleaning vertical hard surfaces having greasy build-up deposited thereon, such as plastic, vitreous and metal surfaces, all of which may have shiny finishes. While the all-purpose cleaning composition may also be used in other cleaning applications, such as removing oily soils and stains from fabrics, it is primarily intended for cleaning hard, shiny surfaces, and desirably requires little or no rinsing. The improved cleaning compositions of the invention exhibit superior grease removal actions, especially when used in the concentrated gel form, and leave the cleaned surfaces shiny, sometimes without any need for rinsing them. Little or no residue will be seen on the cleaned surfaces, which overcomes one of the significant disadvantages of various prior art products, and the surfaces will shine, even after little or no wiping thereof. Surprisingly, this desirable cleaning is accomplished even in the absence of polyphosphates or other inorganic or organic detergent builder salts.

GENERAL DESCRIPTION OF THE INVENTION

In one aspect of the invention, a stable, clear, all-purposed hard surface cleaning composition which is especially effective in the removal of oily and greasy soils from vertical hard surfaces, is in the form of a substantially concentrated gelled microemulsion or somewhat diluted pseudo microemulsion.

The compositions of the instant invention which are preferably gelled microemulsions especially designed for superior removal of grease deposits on hard surfaces and also as a laundry prespotters comprise approximately by weight:

a) 13 to 50% of a mixture of two different anionic surfactants, one of said anionic surfactants being a sulphonate and the other said anionic surfactant being a sulphate, a ratio of the paraffin sulphonate to the alkyl ether sulphate being about 10:1 to about 1:10, more preferably about 4:1 to about 2::1 and most preferably about 3.3:1 to about 2:7;

b) 4 to 20% of at least water insoluble organic compound having a $\delta_H$ of about 0 to about 1$(MPa)^{1/2}$, a $\delta_d$ of about 14 to about 18 $(MPa)^{1/2}$, and a $\delta_p$ of about 0 to about 2 $(MPa)^{1/2}$;

c) 5 to 20% of at least one water soluble hydroxy containing organic compound which is a co-surfactant; and d) optionally 0 to 30 wt % of solids suspended in said gelled microemulsion, wherein said solid is selected from the group consisting of alkali metal detergent builder salts and abrasives, and mixtures thereof., wherein the gelled composition has a complex viscosity at 1 $RAD^{-1}$ of about 1 to about $10^3$ Pascal seconds, more preferably about 5 to about 100 Pascal seconds, a G' value over a strain range of 1 to 50% of at least about 10 Pascals, more preferably at least about 50 Pascals, and a $G^{11}$ value of at least about 10 Pascals, more preferably at least about 50 Pascals over a strain range of 1 to 50%; and e) the balance being water, wherein the interface tension between the lipophile droplets and the aqueous phase is less than about $10^{-2}$mN/m more preferably less than about $10^{-3}$mN/m.

Preferred concentrations of the mentioned components of the concentrated gelled microemulsion are 13 to 50 wt % of synthetic organic detergent, 14 to 20 wt % of the water insoluble inorganic compound, 5 to 20 wt % of co-surfactant system, and the balance being water. At such preferred gelled concentrations, upon dilution of one part of concentrate with four parts of water the resulting pseudo microemulsion will be low in detergent and solvent contents, which may be desirable to avoid excessive foaming and to prevent destabilization of the emulsion due to too great a content of lipophilic phase therein after dissolving in the suitable hydrocarbon or other solvent of the oily or greasy soil to be removed from a substrate to be cleaned. In the absence of builders when the cleaning composition consists of or consists essentially of the described components (with minor proportions of compatible adjuvants being permissible), a chalky appearance of the clean surface is avoided and rinsing may be obviated. Among the desirable adjuvants that may be present in the pseudo microemulsions are divalent or polyvalent metal salts, as sources of magnesium and aluminum, for example, which improve cleaning performances of the dilute compositions, and higher fatty acids and/or higher fatty acid soaps, which act as foam suppressants. Of course, if it is considered aesthetically desirable for the normally clear gelled microemulsions to be cloudy or pearlescent in appearance, an opacifying or pearlescing agent may be present and in some instances, when it is not considered disadvantageous to have to rinse the builder or an abrasive off the substrate, builder salts, such as polyphosphates, may be present in the gelled microemulsions.

Some preferred "dilute" pseudo microemulsion cleaning compositions of this invention are those which are of formulas such as are producible by mixing four parts by weight of water with one part by weight of the concentrated gelled microemulsion previously described. When other dilutions are employed, from 1:1 to 1:19 of concentrated gelled microemulsion:water, the percentages of such ranges and preferred ranges should be adjusted accordingly. In some instances dilutions to 1:99 are feasible and such diluted compositions may be used as is or may be further diluted in some applications, as when employed for hand dishwashing (with rinsing).

Although most of the gelled microemulsions of this invention are of the oil-in-water (o/w) type, some may be water-in-oil (w/o), especially the concentrates. Such may change to o/w on dilution with water, but both the o/w and w/o microemulsions are stable. However, the preferred detergent compositions are oil-in-water gelled microemulsions, whether as concentrates of after dilution with water, with the essential components thereof being detergent, water insoluble organic compound, co-surfactant and water.

The concentration of the paraffinic or linear alkyl benzene sulphonate in the instant composition is about 0 to about 12 wt %, more preferably about 1 to about 10 wt % and the concentration of the alkyl ether sulphate is about 13 to about 38 wt %, more preferably about 15 to about 30 wt %.

Among the advantages of the present invention over previously known liquid detergent compositions are the following:

1. Liquid detergent compositions embodying the invention can be produced having comparably efficacy and properties with lower percentages of active ingredients and comparable clarity with significantly lower percentages of solubilizers than are disclosed in previously known compositions for the removal of grease deposits.

2. Compositions embodying the present invention can produce foam as good or better than that produced by prior art compositions, both in quantity and durability.

3. Compositions embodying the present invention, when diluted to the same concentration for use as the prior art compositions, can give substantially better performance as to grease removal, particularly in dishwashing.

4. Washing solutions made with compositions embodying the present invention have significantly lower surface tension than solutions of the same concentration using prior art compositions.

5. The gelled microemulsions are more readily adaptable to be applied to a vertical surface.

Additional advantages of the present invention are improved and controlled performance such as foaming and dishwashing ability, viscosity and clarity, which are important features in consumer acceptability.

The paraffin sulphonates (A) used in the compositions of the present invention are usually mixed secondary alkyl sulphonates having from 10 to 20 carbon atoms per molecule; preferably at least 80%, usually at least 90%, of the alkyl groups will have 13–17 carbon atoms per molecule. Where the major proportion has 14–15 carbon atoms per molecule, optimum foaming performance appears to be obtained at varying concentrations and water hardnesses. Another useful sulfonated anionic surfactant is a linear sodium alkyl benzene sulfonate (LAS) which is characterized by the formula:

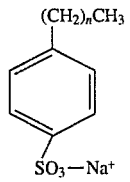

wherein n is from about 9 to about 15.

The sulphonates are generally present in amounts from 15% to 60%, preferably 20% to 35%, by weight of the composition.

The higher alkyl ether sulphates (C) used in the compositions of the present invention are represented by the formula:

$$RO\ (C_2H_4O)_nSO_3X$$

in which R represents a primary or secondary alkyl group that may be straight or branched having from 10 to 18 carbon atoms, preferably from 12 to 15, X is a suitable water soluble cation, as hereinafter defined, and nils from 1 to 1 0, preferably from 2 to 6. These sulphates are produced by sulphating the corresponding ether alcohol and then neutralizing the resulting sulphuric acid ester.

The cation of the paraffin sulphonate (A), the linear alkyl benzene sulfonate (B) and the alkyl ether sulphate (C) may be an alkali metal (e.g. sodium or potassium), an alkaline earth metal (e.g. magnesium), ammonium or lower amine (including alkylolamines). It is preferred to use the sodium salt of the paraffin sulphonic acid and the linear alkyl benzene sulfonic acid and a sodium salt of the alkyl ether sulphuric acid ester oxide, dodecyl phenol condensed with 15 moles of ethylene oxide, and dinonyl phenol condensed with 15 moles of ethylene oxide. These aromatic compounds are not as desirable as the aliphatic alcohol ethoxylates in the invented compositions because they are not as biodegradable.

The co-surfactant component which is at least one water soluble organic compound plays an essential role in the concentrated gelled and diluted pseudo microemulsions of this invention. In the absence of the co-surfactant the water, detergent(s) and water insoluble organic compound, when mixed in appropriate proportions, will form either a micellar solution at lower concentrations, a gelled microemulsion, or a conventional oil-in-water emulsion. With the presence of the co-surfactant in such systems in interfacial tension or surface tension at the interfaces between the lipophile droplets and the continuous aqueous phase is greatly reduced, to a value close to ($1\times10^{-3}$ dynes/cm). This reduction of the interfacial tension results in spontaneous disintegration of the dispersed phase globules or droplets until they become so small that they cannot be perceived by the unaided human eye, and a clear gelled microemulsion is formed, which appears to be transparent. In such gelled microemulsion state thermodynamic factors come into balance, with varying degrees of stability being related to the total free energy of the pseudo microemulsion. Some of the thermodynamic factors involved in determining the total free energy of the system are (1) particle-particle potential; (2) interfacial tension or free energy (stretching and bending); (3) droplet dispersion entropy; and (4) chemical potential changes upon formation of the pseudo microemulsion. A thermodynamically stable system is achieved when interfacial tension or free energy is minimized and when droplet dispersion entropy is maximized. Thus, it appears that the role of the co-surfactant in formation of a stable o/w gelled microemulsion is to decrease interfacial tension and to modify the gelled microemulsion structure and increase the number of possible configurations. Also it seems likely that the co-surfactant helps to decrease rigidity of the dispersed phase with respect to the continuous phase and with respect to the oily and greasy soils to be removed from surfaces to be contacted by the microemulsions.

The amount of co-surfactant employed to stabilize the gelled microemulsion compositions will depend on such factors as the surface tension characteristics of the co-surfactant, the types and proportions of the detergents and perfumes, and the types and proportions of any additional components which are present in the composition and which have an influence on the thermodynamic factors previously enumerated. Generally, amounts of co-surfactant in a preferred range of 5 to 20%, more preferably 6 to 18% and especially preferred 8 to 18%, provide stable gelled o/w microemulsions for the above-described levels of primary surfactants, water insoluble organic compound, and any other additives as described below, in the gelled microemulsions. The preferred co-surfactants of the instant gelled compositions are at least water soluble hydroxy compounds having at least one hydroxyl group and having about 2 to about 12 carbon atoms preferably from 2 to 10 and more preferably from 2 to 8. Especially preferred co-surfactants are BUTYLCARBITOL (i.e., diethylene glycol butyl ether) propylene glycol mono butyl ether, propylene glycol, isopropyl alcohol and ethanol, and mixtures thereof.

The water insoluble organic compound of the instant composition can be one or more water insoluble organic compounds which have an average $\delta_H$ (hydrogen bonding solubility parameter) of about 0 to about 1 $(M\ Pa)^{1/2}$, an average $\delta_p$ (polar solubility parameter) of about 0 to about 2 $(MPa)^{1/2}$, and an average $\delta_p$ (dispersion solubility parameter) of about 14 to about 18$(MPa)^{1/2}$. When the water insoluble compound has these average solubility parameters, the pseudo microemulsion composition of the instant invention will exhibit maximum grease cleaning capacity for the removal of grease deposits of hard surface. The water insoluble organic compounds are selected from the group consisting of D-limonene, Isopars sold by Exxon Chemical and an aliphatic or isoaliphatic hydrocarbons having about 8 to about 16 carbon atoms. The concentration of the water insoluble organic compound in the composition is about 1 to about 20 wt %, more preferably about 5 to about 10 wt %.

The pHs of the final gelled microemulsion will be dependent in large part on the identity of the co-surfactant compound, with the choice of the co-surfactant also being affected by cost and cosmetic properties, often particularly odor or fragrance. For example, gelled microemulsion compositions which are to have a pH in the range of 1 to 10 may employ either an alkanol, propylene glycol, or ethylene glycol or propylene glycol ether or ester, or an alkyl phosphate as the sole co-surfactant but such pH range may be reduced to 1 to 8.5 when polyvalent metal salt is present.

In addition to their excellent capacity for cleaning greasy and oily soils, the low pH o/w gelled microemulsion formulations of this invention also exhibit excellent other cleaning properties. They satisfactorily remove soap scum and lime scale from hard surfaces when applied in neat (undiluted) form, as well as when they are diluted. For such applications onto originally hard shiny surfaces having surface deposits of lime scale and/or soap scum, which may also be soiled with oily and greasy deposits, the microemulsions may be of a pH in the 0.5 to 6 range, preferably 1 to 4 and more preferably 1.5 to 3.5. For general cleaning of oily and greasy surfaces, without lime scale or soap scum deposits, the pH maybe in the range of 1 to 11 and sometimes 6–11 or 6–8 will be preferred and more preferred, respectively (for mildness and effectiveness).

The final essential component of the invented microemulsions is water. Such water may be tap water, usually of less then 150 ppm hardness, as $CaCO_3$, but preferably will be deionized water or water of hardness less than 50 ppm, as $CaCO_3$. The proportion of water in the pseudo o/w microemulsion compositions generally is in the range of 15 to 85%.

The gel composition can have 0 to about 30 wt %, more preferably about 1 to about 20 wt %, of at least one alkali metal detergent builder salt, said detergent builder salt being selected from the group consisting of alkali metal polyphosphates, alkali metal pyrophosphates, alkali metal silicates, alkali carbonates, alkali bicarbonates and alkali gluconates, and mixtures thereof.

The abrasive employed in the invention may be inorganic or polymeric. The inorganic abrasives are selected from the group consisting of quartz, pumice, samicite, titanium dioxide, aluminum oxide, silica sand, feldspar, silicon carbide and the like, and mixtures thereof. The inorganic abrasives can be used along or in combination with polymeric abrasives. The inorganic abrasives which have a Mohr hardness of less than about 3, more preferably less than about 2.75 and are employed in the composition at about 0 wt % to about 30 wt %, more preferably about 1 to about 15.

The polymeric abrasive may be any material derived from a polymerizable composition, such as polyethylene, polypropylene, polystyrene, polyester, polyvinyl chloride, polyvinyl acetate, polymethyl methacrylate, and various copolymers and interpolymers of the foregoing. The criteria for suitability are that the material does not scratch polymethyl methacrylate and that the average particle size ranges from about 10 to 150 microns and preferably from 25 to 100 microns and most preferably from 30 to 75 microns, e.g. 60 microns. For optimum performance, it is most desirable to utilize a polyvinyl chloride abrasive powder whose average particle size is about 60 microns, with a major amount being within the range of 30 to 75 microns. The molecular weight ranges of the polymeric abrasives may vary widely just so long as the physical properties set out above are met. Generally, molecular weights will range from several thousand (e.g., 2000, 5000, 20,000) to several hundred thousand (e.g., 125,000, 250,000, 400,000) and upwards of several million (e.g., 1,000,000, 2,000,000, 4,000,000, 6,000,000). The amount of abrasive may range from about 2% to 30% or more (e.g., 40%, 50%). A preferred range in the preferred formulations is from 5% to 25% and more preferred a range of 5% 1to 15%, such as 7%, 10% or 12%.

The concentrated gelled o/w microemulsion liquid all-purpose cleaning compositions of this invention are effective when used as is, without further dilution by water, but it should be understood that some dilution, without disrupting the microemulsion, is possible and often may be preferable, depending on the levels of surfactants, co-surfactants, water insoluble organic compounds, and other components present in the composition. For example, at preferred low levels of anionic dilutions up to about 50% will be without any phase separation (the microemulsion state will be maintained) and often much greater dilutions are operative. Even when diluted to a great extent, such as 2- to 10-fold or more, for example, the resulting compositions are often still effective in cleaning greasy, oily and other types of lipophilic soils.

It is within the scope of this invention to formulate various concentrated microemulsions which may be diluted with additional water before use.

The concentrated microemulsions, like other such emulsions previously mentioned, can be diluted by mixing with up to about 20 times or more, even sometimes to 100 times, but preferably about 3 or 4 to about 10 times their weight of water, e.g. 4 times, to form microemulsions similar to the diluted microemulsion compositions described above. While the degree of dilution is suitably chosen to yield a microemulsion composition after dilution, it should be recognized that during and at the ends of dilutions, especially when diluting from concentrated emulsions, pseudo microemulsion stages may be encountered.

Optionally, the o/w gelled microemulsion compositions may include minor proportions, e.g. 0.1 to 2.0% preferably 0.25 to 1.0%, on a dilute product basis, of a $C_{8-22}$ fatty acid or fatty acid soap as a foam suppressant. The addition of free higher fatty acid or fatty acid soap provides an improvement in the rinsability of the composition, whether the microemulsion is applied in neat or diluted form. Generally, however, it is desirable to increase the level of co-surfactant, as to 1.1 to 1.5 times its otherwise normal concentration, to maintain product stability when the free fatty acid or soap is present.

Examples of the fatty acids which can be used as such or in the form of soaps, include distilled coconut oil fatty acids, "mixed vegetable" type fatty acids (e.g. those of high percentages of saturated, mono- and/or poly-unsaturated $C_{18}$ chains), oleic acid, stearic acid, palmitic acid, eicosanoic acid, and the like. Generally those fatty acids having from 8 to 22 carbon atoms therein are operative.

The composition can optionally contain 0 to about 5 wt % of an alkyloamide as a foam builder. Its presence results in a product which exhibits high foaming power in use, particularly in the stability of the foam generated during dishwashing or laundering operations. It should not be employed in an amount sufficient to impair the desired physical properties. The acyl radical of the alkylolamide is selected from the class of fatty acids having from 8 to 18 carbon atoms and each alkylol group usually has up to 3 carbon atoms. It is preferred to use the monoethanolamides of lauric and myristic acids but diethanolamides and isopropanolamides as well as monoethanolamides of fatty acids having from 10 to 14 Carbon atoms in the acyl radical are satisfactory. Examples are capric, lauric, and myristic and "heart cut" coconut ($C_{12}$-$C_{14}$) monoethanolamides, diethanolamides and isopropanolamides and mixtures thereof. There may be employed also the alkylolamides which are substituted by additional ethenoxy groups; suitable examples may be the above amides condensed with from 1 to 4 moles of ethylene oxide.

The protein optionally employed in the compositions of this invention is a water-soluble partially degraded protein and may be a partially enzymatically hydrolyzed protein or a heat derived product of protein. This material may be employed as an agent to overcome the irritant effect upon the skin of the surface active compounds. When the partially degraded protein is applied together with or subsequent to contact with the surface active compounds, the prophylactic effect is found to be present. The partially degraded protein is characterized as having a gel strength of about 0 to about 200 Bloom grams. The partially degraded protein may also provide rinse and drain properties to the composition. Such hydrolysis, such as by the action of trypsin, or pancreatic enzymes on protein material. The partially degraded protein may also be a heat derived decomposition product of protein. Proteins partially degraded by heat and having the required Bloom strength for use in the compositions may be prepared by heating proteinaceous material such as bones, feet or skin of pork or beef which has been reduced to small pieces and immersed in water, by autoclaving. A preferred hydrolyzed protein is a partially enzymatically hydrolyzed protein derived from beef collagen. Typical proteins which may be partially hydrolyzed for use in the compositions include casein, gelatin, collagen, albumin, zein, keratin, fibroin, globulin and glutenin. Typical commercial partially enzymatically hydrolyzed proteins include Bacto-Proteose, proteose-peptone, casein-peptone, gelatin-peptone, Bacto-peptone, vegetable peptones, such as soybeans peptone, the solubilized collagen being derived by heating bones, feet or skin of pork or beef. The preferred proteins are solubilized beef collagen and solubilized pork collagen. The partially hydrolyzed protein may have a relatively broad spectrum of molecular weights in the range from about 500 to about 70,000, preferably from about 500 to about 10,000 for hand care effects and from about 25,000 to about 70,000 for good drain properties. The lower molecular weight proteins may contain some completely degraded polypeptides, such as dipeptides and tripeptides and even some amino, acids as a results of the degradation process. The protein, where employed, will generally be used in amounts in the range from 0.1 to 2.0% by weight, preferably from 0.3 to 0.8% by weight.

The liquid detergent compositions of the present invention may also contain any of the additives used in other liquid detergent compositions such as sequestrants, e.g. salts of ethylenediamine tetraacetic acid, such as the sodium and potassium salts, and salts of hydroxy ethyl ethylene diamine triacetate. If it is desirable to tint or color the liquid detergent composition, any suitable dyes may be used for this purpose. Perfume may also be added to the compositions to give them a pleasant odor.

When the concentrated gel microemulsion is diluted, the all-purpose liquids are clear pseudo microemulsions and exhibit satisfactory stability at reduced and increased temperatures. More specifically, such compositions remain clear and stable in the range of 5° C. to 50° C., especially 10° C. to 43° C. They exhibit a pH in the acid, neutral or alkaline range, e.g. 1–11, depending on intended end use, with acidic and neutral pHs, e.g. 2 to 7 or 2 to 8 being preferred and with acidic pHs, e.g. 1–4 or 2–3.5 being considered best for lime scale and soap scum removal applications. The diluted liquids formed from the gelled microemulsion are readily pourable and exhibit a viscosity in the range of 5 to 150 or 200 centipoises, preferably 6 to 60 centipoises (cps) and more preferably 10 to 40 cps, as measured at 25° C. with Brookfield RVT Viscometer, using a No. 1 spindle rotating at 20 rpm.

The liquid gelled compositions are preferably packaged in containers of synthetic organic polymeric plastic, e.g. PVC, polyethylene or polypropylene.

Because the compositions, as prepared, are aqueous liquid formulations and because often no particular mixing procedure is required to be followed to cause formation of the desired gelled microemulsions, the compositions are easily prepared, often simply by combining all of the components thereof in a suitable vessel or container. The order of mixing the ingredients in such cases is not particularly important and generally the various materials can be added sequentially or all at once or in the form of aqueous solutions or each or all of the primary detergents and co-surfactants can be separately prepared and combined with each other, followed by the water insoluble organic compound. However, to avoid any problems with the gelled microemulsions breaking or not forming properly one may make a solution of the synthetic detergent(s) in water, dissolve the co-surfactant therein, and then admix in the water insoluble organic compound, which thus spontaneously forms the concentrated gelled pseudo microemulsion, which operations are conducted at a temperature in the 5° to 50° C. range, preferably 10° to 43° C. and more preferably 20° to 30° C. If fatty acid is to be employed for its antifoaming effect, it will preferably be melted and added to the surfactant-co-surfactant solution, followed by the water insoluble organic compound. Dilute pseudo microemulsions can be made from the concentrated pseudo microemulsion by dilution with at least 50% thereof of water, with both the pseudo microemulsion and the water being in the described temperature range. The products resulting are of dispersed lipophilic phase droplet sizes in the range of 50 to 500 Å, preferably 100 to 500 Å, with the smaller particle sizes promoting better absorption of oily soils from soiled substrates to be cleaned.

DETAILED DESCRIPTION OF THE PREFERRED EMBODIMENT

The following examples illustrate liquid cleaning compositions of the present invention. Unless otherwise specified, all percentages and parts given in these examples, this specification and the appended claims are by weight and all temperatures are in °C. The exemplified compositions are illustrative only and do not limit the scope of the invention.

Example 1

The following examples were prepared at room temperature by dissolving the anionic surfactants in the water, then dissolving the co-surfactant, followed by admixing in the water insoluble organic compound into the water solution to form a stable gelled homogenous o/w microemulsion. The formulas were tested for appearance and miniplates. The examples and test results are as follows:

| | A | B | C | D | E | F | G | H | I | J | K |
|---|---|---|---|---|---|---|---|---|---|---|---|
| Paraffin sulphonate | 15 | 9 | 9 | 9 | 3 | 3 | 20 | 12 | 20 | 9 | 9 |
| Sodium lauryl ether sulfate | 12 | 19 | 30 | 32 | 30 | 38 | 5 | 16 | 5 | 9 | 22 |
| D-Limonene | 10 | 3 | 3 | 3 | 2 | 1 | 7 | 5 | 7 | 3 | 4 |
| Butyl carbitol | 8 | 8 | 13 | 14 | 19 | 16 | | 7 | | 4 | 9 |
| Ethylene glycol mono butyl ether | | | | | | | | | 3 | | |
| Water | Bal. | Bal. | Bal. | Bal. | Bal. | Bal. | Bal. | Bal. | Bal. | Bal. | Bal. |
| Appearance | gel | gel | gel | gel | gel | gel | liquid | gel | liquid | gel | gel |
| Miniplate test | | | | | | | | | | | |

The test procedure is as follows:

A) The Miniplate Test procedure is as follows:

Principle

This test aims at assessing the foam stability of a LDLD solution in presence of a fatty soil.

Soil

Vegetable shortening: Crisco (from US)

This fat is injected in the LDLD solution with a syringe at a flow rate of 0.6 G/Min.

Product Concentration

10 ML of a 5% LDLD solution are added to 400 ML of water (=1.25 GR/L of LDLD)

Test Procedure

During 1 minute foam is generated with a brush (according a hypocycloidal pattern). The brush keeps moving to help fat emulsification. Fatty soil is then injected in the solution at a constant foam generation and disappearance are evaluated by photo electrical cell and recorded automatically.

Results

Miniplate number: MP=(GC×GF×ΔT)/0.12

GC=Grease Coefficient

GF=Grease flow equal to (total injected grease weight)/(T2-T0)

ΔT=Time measured from the beginning of grease injection (TO) and the end of foam detection (T1)

0.12=Correlation coefficient to relate the calculated miniplate number to the number of dishes washed by hand in similar conditions T2=End of test, grease injection is stopped Extrapolation Actual plate number can be easily extrapolated from miniplate number by assuming that each large plate is soiled with 3 GR of fat. (Number of miniplates)×(weight of product)×0.08

What is claimed is:

1. A gelled hard surface cleaner composition comprising approximately by weight:

a) 13 to 50% of a mixture of a paraffin sulphonate and an alkyl ether sulphate and the ratio of the paraffin sulphonate to said alkyl ether sulphate is about 4:1 to 2:1;

b) 1 to 20% of at least one of a water insoluble organic compound; selected from the group consisting of D-limonene and aliphatic and isoaliphatic hydrocarbons having about 8 to about 16 carbon atoms and mixtures thereof and has a $\delta_p$ of about 0 to about 2, a $\delta_H$ of about 0 to about 1 $(MPa)^{1/2}$, and a $\delta_d$ of about 14 to about 18 $(MPa)^{1/2}$;

c) 5 to 20% of at least one water soluble hydroxy containing organic compound selected from the group consisting of diethylene glycol butyl ether, propylene glycol, ethanol, and isopropanol and mixtures thereof and d) the balance being water, wherein the composition has a pH of about 1 to about 11, a complex viscosity at 1 rad $s^{-1}$ of about 1 to about $10^3$ Pascal seconds and the interfacial tension between the lipophile droplets of said composition and the aqueous phase being less than about $10^{-2}$mN/m.

2. The composition of claim 1, wherein said water soluble hydroxy organic compound has about 2 to about 12 carbon atoms.

3. The composition of claim 1, wherein said water insoluble organic compound is D-limonene.

4. The composition according to claim 1, wherein said composition is a gelled microemulsion.

5. The composition of claim 1, further including a partially degraded protein.

6. The composition of claim 1, further including an alkylolamide or the ethoxylated species.

7. The composition of claim 1, further including a sequestrant.

8. The composition of claim 1, further including an abrasive.

9. The composition of claim 1, further including at least one alkali metal detergent builder salt.

* * * * *